US005830408A

United States Patent [19]

Azuma et al.

[11] Patent Number: 5,830,408

[45] Date of Patent: Nov. 3, 1998

[54] STAINLESS STEEL FOR HIGH-PURITY GASES

[75] Inventors: Sigeki Azuma; Masahiro Honzi, both of Osaka, Japan

[73] Assignee: Sumitomo Metal Industries, Ltd., Osaka, Japan

[21] Appl. No.: 624,527

[22] PCT Filed: Oct. 17, 1994

[86] PCT No.: PCT/JP94/01737

§ 371 Date: Apr. 10, 1996

§ 102(e) Date: Apr. 10, 1996

[87] PCT Pub. No.: WO95/11321

PCT Pub. Date: Apr. 27, 1995

[30] Foreign Application Priority Data

| | | | |
|---|---|---|---|
| Oct. 20, 1993 | [JP] | Japan | 5-262005 |
| Mar. 2, 1994 | [JP] | Japan | 6-031733 |
| Mar. 8, 1994 | [JP] | Japan | 6-036661 |

[51] Int. Cl.[6] ..... C22C 38/42; C22C 38/44; C22C 38/40

[52] U.S. Cl. ..... 420/43; 420/584.1

[58] Field of Search ..... 420/43, 584.1

[56] References Cited

U.S. PATENT DOCUMENTS

| | | | |
|---|---|---|---|
| 3,486,885 | 12/1969 | Armijo | 420/43 |
| 5,164,270 | 11/1992 | Natesan | 420/584.1 |

FOREIGN PATENT DOCUMENTS

| | | |
|---|---|---|
| 60-211054 | 10/1985 | Japan . |
| 63-161145 | 7/1988 | Japan . |
| 1-198463 | 8/1989 | Japan . |
| 1-219144 | 9/1989 | Japan . |
| 3-082739 | 4/1991 | Japan . |
| 3-285049 | 12/1991 | Japan . |
| 4-228547 | 8/1992 | Japan . |
| 5-59524 | 3/1993 | Japan . |
| 6-33192 | 2/1994 | Japan . |

OTHER PUBLICATIONS

Tomoyuki Koyama et al., "*Special Technique for Non–Corrosive, Non–Catalytic $Cr_2O^3$ Stainless Steel Pipes*", the 24th VLSI Ultra–Clean Technology Workshop held by Ultra Clean Society, Jun. 5, 1993, pp. 55–67.

*Primary Examiner*—Deborah Yee

*Attorney, Agent, or Firm*—Burns, Doane, Swecker & Mathis, LLP

[57] ABSTRACT

Stainless steels for high-purity gases which are superior in non-dusting characteristics required at the time of welding, corrosion resistance and non-catalytic property and which can be widely utilized in the manufacturing process of semiconductors, liquid crystal displays or the like. The austenitic stainless steels of the present invention are characterized by having decreased Mn, Al, Si and O contents. The austenitic stainless steels meet the non-dusting characteristics which are required at the time of welding. In addition, corrosion resistance, abrasion resistance and machinability are improved. The ferritic and the duplex stainless steels of the present invention are characterized in that they can readily form thereon a Cr oxide layer when subjected to oxidation treatment. The ferritic and two-phase stainless steels are superior in corrosion resistance to corrosive gases, and contain non-catalytic property against chemically-unstable gases.

15 Claims, 10 Drawing Sheets

Fig. 2

| Type of Steel | Chemical Composition (Wt%, bal.: Fe, Impurities) | | | | | | | | | | | | | | | | Remarks |
|---|---|---|---|---|---|---|---|---|---|---|---|---|---|---|---|---|---|
| | C | Si | Mn | P | S | Ni | Cr | Cu | Mo | W | Al | N | O | Ni eq. | Cr eq. | Nibal. | |
| A | 0.008 | 0.15 | 0.03 | 0.005 | 0.001 | 11.2 | 17.6 | — | — | — | 0.007 | — | 0.002 | 11.455 | 17.825 | 0.0475 | Inventive Example |
| B | 0.007 | 0.13 | 0.03 | 0.004 | 0.001 | 8.8 | 19.4 | — | — | — | 0.005 | 0.21 | 0.002 | 15.325 | 19.595 | 1.9705 | |
| C | 0.005 | 0.18 | 0.04 | 0.002 | 0.001 | 14.6 | 17.3 | — | 2.64 | — | 0.008 | — | 0.001 | 14.77 | 20.21 | 0.739 | |
| D | 0.011 | 0.11 | 0.03 | 0.007 | 0.001 | 14.2 | 16.9 | 0.24 | 2.32 | — | 0.008 | — | 0.005 | 14.785 | 19.385 | 1.6615 | |
| E | 0.002 | 0.42 | 0.14 | 0.004 | 0.002 | 12.1 | 17.6 | — | 2.73 | — | 0.005 | 0.15 | 0.004 | 16.67 | 20.96 | 1.874 | |
| F | 0.005 | 0.19 | 0.01 | 0.002 | 0.001 | 26.5 | 25.6 | 0.42 | 5.23 | 0.56 | 0.003 | — | 0.002 | 27.075 | 31.675 | 0.4325 | |
| G | 0.004 | 0.23 | 0.06 | 0.004 | 0.002 | 35.2 | 29.2 | — | 6.81 | 1.52 | 0.009 | — | 0.002 | 35.33 | 37.875 | 1.8875 | |
| H | 0.012 | 0.16 | 0.22* | 0.005 | 0.002 | 14.2 | 16.8 | — | 2.35 | — | 0.007 | — | 0.005 | 14.625 | 19.39 | 1.536 | Comparative Example |
| I | 0.005 | 0.24 | 0.31* | 0.006 | 0.001 | 14.6 | 17.2 | — | 2.68 | — | 0.004 | — | 0.001 | 14.88 | 20.24 | 0.841 | |
| J | 0.009 | 0.12 | 0.59* | 0.007 | 0.001 | 13.6 | 16.5 | — | 2.64 | — | 0.008 | — | 0.001 | 14.165 | 19.32 | 1.113 | |
| K | 0.012 | 0.34 | 0.72* | 0.009 | 0.002 | 12.8 | 16.3 | — | 2.35 | — | 0.007 | — | 0.002 | 13.52 | 19.16 | 0.644 | |
| L | 0.008 | 0.23 | 0.05 | 0.004 | 0.001 | 11.8 | 17.6 | — | — | — | 0.021* | — | 0.003 | 12.065 | 17.945 | 0.5255 | |
| M | 0.007 | 0.21 | 0.03 | 0.006 | 0.001 | 13.9 | 16.9 | — | 2.13 | — | 0.016* | — | 0.002 | 14.125 | 19.345 | 1.0455 | |

(Note) Mark '*' means that the value shown with this mark does not fall in the range of the present invention.

Fig. 3

| Welding Process | | Automatic GTA Welding, No Weld Material Used |
|---|---|---|
| Welding Conditions | Electric Current | 15 ~ 21 A |
| | Voltage | 15 ~ 21 V |
| | Time | 23 ~ 34 sec |
| | Internal Shielding | 99.99% or higher Ar, Flow Rate 10 liter/min |

Fig. 4

| Type of Steel | Number of Particles Produced (pieces/1000) | Metal Concentration in Hydrochloric Acid (ppb) | | | | | Hardness (Hv 10 kg) | Remarks |
|---|---|---|---|---|---|---|---|---|
| | | Mn | Fe | Cr | Ni | Al | | |
| A | <0.2 | < 5 | < 5 | < 5 | < 5 | < 5 | 98 | Inventive Example |
| B | <0.2 | < 5 | < 5 | < 5 | < 5 | < 5 | 141 | |
| C | <0.2 | < 5 | < 5 | < 5 | < 5 | < 5 | 112 | |
| D | <0.2 | < 5 | < 5 | < 5 | < 5 | < 5 | 105 | |
| E | <0.2 | < 5 | < 5 | < 5 | < 5 | < 5 | 153 | |
| F | <0.2 | < 5 | < 5 | < 5 | < 5 | < 5 | 119 | |
| G | <0.2 | < 5 | < 5 | < 5 | < 5 | < 5 | 120 | |
| H | 2.5 | 36 | < 5 | < 5 | < 5 | < 5 | — | Comparative Example |
| I | 12 | 153 | < 5 | < 5 | < 5 | < 5 | — | |
| J | 45 | 355 | < 5 | < 5 | < 5 | < 5 | — | |
| K | 85 | 586 | < 5 | < 5 | < 5 | < 5 | — | |
| L | 1.3 | < 5 | < 5 | < 5 | < 5 | 12 | — | |
| M | 3.2 | < 5 | < 5 | < 5 | < 5 | 24 | — | |

Fig. 5

| Type of Steel | Chemical Composition (Wt%, bal.: Fe, Impurities) | | | | | | | | | | | | | | | | | | Remarks |
|---|---|---|---|---|---|---|---|---|---|---|---|---|---|---|---|---|---|---|---|
| | C | Si | Mn | P | S | Ni | Cr | Cu | Mo | W | Al | Se | B | N | O | Ni eq. | Cr eq. | Nibal. | |
| a | 0.008 | 0.15 | 0.03 | 0.005 | 0.001 | 11.2 | 17.6 | — | — | — | 0.007 | — | — | — | 0.002 | 11.455 | 17.825 | 0.0475 | |
| b | 0.005 | 0.06 | 0.03 | 0.014 | 0.001 | 11.4 | 17.6 | — | — | — | 0.003 | — | — | — | 0.002 | 11.565 | 17.69 | 0.306 | |
| c | 0.005 | 0.18 | 0.04 | 0.002 | 0.001 | 14.6 | 16.9 | — | 2.64 | — | 0.008 | — | — | — | 0.001 | 14.77 | 19.81 | 1.179 | |
| d | 0.002 | 0.04 | 0.02 | 0.017 | 0.002 | 14.2 | 17.2 | — | 2.51 | — | 0.003 | — | — | — | 0.003 | 14.27 | 19.77 | 0.723 | |
| e | 0.011 | 0.11 | 0.03 | 0.007 | 0.001 | 14.2 | 16.9 | 0.24 | 2.32 | — | 0.008 | — | — | — | 0.005 | 14.785 | 19.385 | 1.6615 | |
| f | 0.006 | 0.04 | 0.04 | 0.013 | 0.001 | 13.6 | 17.8 | 0.36 | 2.46 | — | 0.004 | — | — | — | 0.003 | 14.16 | 20.32 | 0.008 | Inventive |
| g | 0.004 | 0.23 | 0.06 | 0.004 | 0.002 | 35.2 | 29.2 | — | 6.81 | 1.52 | 0.009 | — | — | — | 0.002 | 35.35 | 37.875 | 1.8875 | |
| h | 0.004 | 0.23 | 0.06 | 0.004 | 0.002 | 35.2 | 29.2 | — | 6.91 | 1.52 | 0.004 | — | — | — | 0.002 | 35.35 | 37.875 | 1.8875 | Example |
| i | 0.005 | 0.19 | 0.01 | 0.002 | 0.001 | 26.5 | 25.6 | 0.42 | 5.23 | 0.56 | 0.003 | — | — | — | 0.002 | 27.075 | 31.675 | 0.4325 | |
| j | 0.006 | 0.05 | 0.02 | 0.012 | 0.001 | 25.2 | 25.1 | 0.39 | 4.68 | 0.68 | 0.008 | — | — | — | 0.004 | 25.78 | 30.535 | 0.3915 | |
| k | 0.007 | 0.13 | 0.03 | 0.004 | 0.001 | 8.8 | 19.4 | — | — | — | 0.005 | — | — | 0.21 | 0.002 | 15.325 | 19.595 | 1.9705 | |
| l | 0.006 | 0.02 | 0.01 | 0.011 | 0.001 | 12.1 | 17.9 | — | 2.36 | — | 0.002 | — | — | 0.12 | 0.002 | 15.885 | 20.29 | 1.766 | |
| m | 0.002 | 0.42 | 0.14 | 0.004 | 0.002 | 12.1 | 17.6 | — | 2.73 | — | 0.005 | — | — | 0.15 | 0.004 | 16.73 | 20.96 | 1.874 | |
| n | 0.004 | 0.03 | 0.05 | 0.014 | 0.001 | 12.2 | 17.8 | — | 2.49 | — | 0.003 | — | 0.008 | 0.12 | 0.002 | 15.945 | 20.335 | 1.7765 | |
| o | 0.009 | 0.04 | 0.03 | 0.01 | 0.001 | 13.9 | 16.8 | — | 2.69 | — | 0.003 | 0.001 | — | — | 0.003 | 14.185 | 19.55 | 0.88 | |
| p | 0.003 | 0.12 | 0.02 | 0.009 | 0.001 | 12.8 | 17.7 | — | 2.85 | — | 0.005 | 0.003 | 0.007 | 0.11 | 0.004 | 16.2 | 20.73 | 1.597 | |

Fig. 6

| Type of Steel | Chemical Composition (Wt%, bal.: Fe, Impurities) | | | | | | | | | | | | | | | | | | Remarks |
|---|---|---|---|---|---|---|---|---|---|---|---|---|---|---|---|---|---|---|---|
| | C | Si | Mn | P | S | Ni | Cr | Cu | Mo | W | Al | Se | B | N | O | Ni eq. | Cr eq. | Nibal. | |
| q | 0.012 | 0.16 | 0.22* | 0.005 | 0.002 | 14.2 | 16.8 | — | 2.35 | — | 0.007 | — | — | — | 0.005 | 14.67 | 19.39 | 1.541 | Comparative Example |
| r | 0.005 | 0.24 | 0.31* | 0.006 | 0.001 | 14.6 | 17.2 | — | 2.68 | — | 0.004 | — | — | — | 0.001 | 14.905 | 20.24 | 0.841 | |
| s | 0.009 | 0.12 | 0.59* | 0.007 | 0.001 | 13.6 | 16.5 | — | 2.64 | — | 0.008 | — | — | — | 0.001 | 14.165 | 19.32 | 1.113 | |
| t | 0.012 | 0.34 | 0.72* | 0.009 | 0.002 | 12.8 | 16.3 | — | 2.35 | — | 0.007 | — | — | — | 0.002 | 13.52 | 19.16 | 0.644 | |
| u | 0.008 | 0.23 | 0.05 | 0.004 | 0.001 | 11.8 | 17.6 | — | — | — | 0.021* | — | — | — | 0.003 | 12.065 | 17.945 | 0.5255 | |
| v | 0.007 | 0.21 | 0.03 | 0.006 | 0.001 | 13.9 | 16.9 | — | 2.13 | — | 0.016* | — | — | — | 0.002 | 14.125 | 19.345 | 1.0455 | |
| w | 0.006 | 0.09 | 0.03 | 0.012 | 0.001 | 14.6 | 17.6 | — | 2.19 | — | 0.007 | — | — | — | 0.014* | 14.795 | 19.925 | 1.0775 | |

(Note) Mark '*' means that the value shown with this mark does not fall in the range of the present invention.

Fig. 7

| | | |
|---|---|---|
| Boring Tool | | SKH51-Made Drill, Diameter 5 mm, Tapered Type |
| Boring Conditions | Feed | 0.12 mm/rev. |
| | Number of Revolutions | 800 rpm |
| | Depth of Bore | Penetrated Bore with Diameter of 9 mm |
| | Lubrication | Water-Soluble Lubricant 4 liter/min |

Fig. 8

| Type of Steel | Number of Particles Produced (pieces/1000) | Metal Concentration in Hydrochloric Acid (ppb) | | | | | (1) Corrosion Resistance | (2) Abrasion Resistance | (3) Weldability | (4) Machinability | Remarks |
|---|---|---|---|---|---|---|---|---|---|---|---|
| | | Mn | Fe | Cr | Ni | Al | | | | | |
| a | <0.2 | < 5 | < 5 | < 5 | < 5 | < 5 | ○ | 98 | ○ | △ | Inventive Example |
| b | <0.2 | < 5 | < 5 | < 5 | < 5 | < 5 | ○ | 102 | ○ | △ | |
| c | <0.2 | < 5 | < 5 | < 5 | < 5 | < 5 | ◎ | 112 | ○ | △ | |
| d | <0.2 | < 5 | < 5 | < 5 | < 5 | < 5 | ◎ | 108 | ○ | △ | |
| e | <0.2 | < 5 | < 5 | < 5 | < 5 | < 5 | ◎ | 105 | ○ | △ | |
| f | <0.2 | < 5 | < 5 | < 5 | < 5 | < 5 | ◎ | 101 | ○ | △ | |
| g | <0.2 | < 5 | < 5 | < 5 | < 5 | < 5 | ◎ | 120 | ○ | △ | |
| h | <0.2 | < 5 | < 5 | < 5 | < 5 | < 5 | ◎ | 141 | ○ | △ | |
| i | <0.2 | < 5 | < 5 | < 5 | < 5 | < 5 | ◎ | 119 | ○ | △ | |
| j | <0.2 | < 5 | < 5 | < 5 | < 5 | < 5 | ◎ | 123 | ○ | △ | |
| k | <0.2 | < 5 | < 5 | < 5 | < 5 | < 5 | ○ | 141 | ○ | △ | |
| l | <0.2 | < 5 | < 5 | < 5 | < 5 | < 5 | ◎ | 136 | ○ | △ | |
| m | <0.2 | < 5 | < 5 | < 5 | < 5 | < 5 | ◎ | 153 | ○ | △ | |
| n | <0.2 | < 5 | < 5 | < 5 | < 5 | < 5 | ◎ | 162 | ○ | ◎ | |
| o | <0.2 | < 5 | < 5 | < 5 | < 5 | < 5 | ◎ | 101 | ◎ | △ | |
| p | <0.2 | < 5 | < 5 | < 5 | < 5 | < 5 | ◎ | 142 | ◎ | ◎ | |

(Notes)
(1) ○: Not corroded with 9% ferric chloride; ◎: Not corroded with 24% ferric chloride.
(2) Vickers hardness Hv 10 kg (The greater, the better)
(3) ○: Variation of uranamibead width is 1 mm or less; ◎: Variation of uranamibead width is 0.3 mm or less.
(4) △: The number of bores is 5 or less; ◎: The number of bores is 20 or more.

Fig. 9

| Type of Steel | Number of Particles Produced (pieces/1000) | Metal Concentration in Hydrochloric Acid (ppb) | | | | | (1) Corrosion Resistance | (2) Abrasion Resistance | (3) Weldability | (4) Machinability | Remarks |
|---|---|---|---|---|---|---|---|---|---|---|---|
| | | Mn | Fe | Cr | Ni | Al | | | | | |
| q | 2.5 | 36 | < 5 | < 5 | < 5 | < 5 | – | – | — | — | Comparative Example |
| r | 12 | 153 | < 5 | < 5 | < 5 | < 5 | – | – | — | — | |
| s | 45 | 355 | < 5 | < 5 | < 5 | < 5 | – | – | — | — | |
| t | 85 | 586 | < 5 | < 5 | < 5 | < 5 | – | – | — | — | |
| u | 1.3 | < 5 | < 5 | < 5 | < 5 | 12 | – | – | — | — | |
| v | 3.2 | < 5 | < 5 | < 5 | < 5 | 24 | – | – | — | — | |
| w | 8.9 | < 5 | < 5 | 14 | < 5 | 47 | – | – | — | — | |

Fig. 10

| Section | Type of Steel | Chemical Composition (Wt%, bal.: Fe, Impurities) | | | | | | | | | | | | | | | Structure of Steel |
|---|---|---|---|---|---|---|---|---|---|---|---|---|---|---|---|---|---|
| | | C | Si | Mn | P | S | Ni | Cr | Mo | Al | Ti | Nb | Cu | W | N | O | |
| Inventive Example | A | 0.009 | 0.18 | 0.11 | 0.011 | 0.001 | – | 21.2 | 2.14 | 0.013 | – | – | – | – | 0.011 | 0.006 | Ferrite |
| | B | 0.003 | 0.12 | 0.02 | 0.008 | 0.002 | – | 25.9 | 1.22 | 0.005 | – | – | – | – | 0.014 | 0.007 | Ferrite |
| | C | 0.002 | 0.03 | 0.03 | 0.018 | 0.001 | 1.85 | 28.9 | 4.12 | 0.002 | – | – | – | – | 0.003 | 0.003 | Ferrite |
| | D | 0.004 | 0.12 | 0.02 | 0.011 | 0.001 | – | 25.6 | 1.26 | 0.011 | – | 0.36 | – | – | 0.004 | 0.004 | Ferrite |
| | E | 0.005 | 0.12 | 0.05 | 0.003 | 0.001 | – | 26.4 | 1.26 | 0.009 | – | – | 0.26 | – | 0.002 | 0.002 | Ferrite |
| | F | 0.006 | 0.21 | 0.02 | 0.009 | 0.001 | 0.56 | 25.9 | 1.56 | 0.011 | 0.34 | 0.38 | – | – | 0.004 | 0.003 | Ferrite |
| | G | 0.005 | 0.06 | 0.05 | 0.013 | 0.002 | 0.61 | 25.8 | 2.32 | 0.011 | – | – | 0.26 | 0.58 | 0.012 | 0.006 | Ferrite |
| | H | 0.006 | 0.12 | 0.12 | 0.008 | 0.001 | – | 26.1 | 1.56 | 0.007 | – | 0.48 | 0.36 | – | 0.004 | 0.004 | Ferrite |
| | I | 0.004 | 0.05 | 0.11 | 0.012 | 0.001 | 0.48 | 25.4 | 1.98 | 0.007 | 0.23 | 0.36 | – | 0.38 | 0.008 | 0.008 | Ferrite |
| | J | 0.012 | 0.14 | 0.11 | 0.009 | 0.001 | 6.68 | 25.4 | 3.21 | 0.011 | – | – | 0.34 | 0.41 | 0.18 | 0.006 | Two Phases |
| | K | 0.007 | 0.16 | 0.08 | 0.008 | 0.001 | 7.12 | 27.6 | 3.59 | 0.006 | – | – | – | – | 0.27 | 0.005 | Two Phases |
| Comparative Example | L | 0.006 | 0.12 | 0.05 | 0.016 | 0.001 | – | 18.2* | 1.23 | 0.003 | – | – | – | – | 0.009 | 0.004 | Ferrite |
| | M | 0.008 | 0.59* | 0.06 | 0.005 | 0.002 | – | 25.6 | 0.48 | 0.006 | – | – | – | – | 0.005 | 0.005 | Ferrite |
| | N | 0.008 | 0.61* | 0.13 | 0.008 | 0.001 | 6.93 | 25.9 | 3.02 | 0.006 | – | – | 0.21 | 0.34 | 0.24 | 0.004 | Two Phases |
| | O | 0.013 | 0.12 | 0.09 | 0.011 | 0.001 | 6.17 | 18.9* | 2.68 | 0.007 | – | – | – | – | 0.16 | 0.006 | Two Phases |

Fig. 11

| Section | Type of Steel | Cr Oxide Layer: Maximum Cr Concentration (atom%) | Cr Oxide Layer: Thickness of Layer (1) | Water-Discharging Property (2) | Corrosion Resistance (3) | Catalytic Property (4) | Total Evaluation | Remarks |
|---|---|---|---|---|---|---|---|---|
| Inventive Example | A | 93 | 1.3 | ◎ | ○ | ○ | ○ | (1): Relative value when the thickness of the layer formed on the steel of type L is taken as 1.<br>(2): ◎:Less than 6 hours were required for vapor concentration to become 1 ppb; ○:Less than 12 hours were required; and ×:12 or more hours were required.<br>(3): ○:Not corroded ×:Corroded<br>(4): ○:Decomposition temperature of silane is 400 °C or higher; ×:Decomposition temperature of silane is lower than 400 °C. |
| | B | 96 | 1.5 | ◎ | ○ | ○ | ○ | |
| | C | 97 | 1.6 | ◎ | ○ | ○ | ○ | |
| | D | 91 | 1.3 | ◎ | ○ | ○ | ○ | |
| | E | 93 | 1.6 | ◎ | ○ | ○ | ○ | |
| | F | 92 | 1.4 | ◎ | ○ | ○ | ○ | |
| | G | 96 | 1.4 | ◎ | ○ | ○ | ○ | |
| | H | 98 | 1.4 | ◎ | ○ | ○ | ○ | |
| | I | 96 | 1.4 | ◎ | ○ | ○ | ○ | |
| | J | 96 | 1.3 | ◎ | ○ | ○ | ○ | |
| | K | 98 | 1.4 | ◎ | ○ | ○ | ○ | |
| Comparative Example | L | 83 | 1 | ○ | × | ○ | × | |
| | M | 81 | 1.2 | ○ | × | ○ | × | |
| | N | 81 | 1.2 | ○ | × | ○ | × | |
| | O | 71 | 0.4 | × | × | ○ | × | |

STAINLESS STEEL FOR HIGH-PURITY GASES

SPECIFICATION

1. Technical Field

The present invention relates to stainless steels for high-purity gases used in the manufacturing process of semiconductors or the like.

2. Background Art

In the field of the manufacturing of semiconductors or liquid crystal displays, the degree of the integration of devices has increased in recent years.

In the manufacturing of a device called VLSI, a fine pattern of 1 micron or less is required. In such a manufacturing process, fine dust or an extremely small amount of gas impurities are deposited to or adsorbed by a wiring pattern to cause a circuit failure. It is therefore necessary that both a reaction gas and a carrier gas used have high purity; that is, only a few particles and gas impurities can be present in these gases. For this reason, a pipe or a member used for such gases that have high-purity is required that the inner surface thereof discharges as contaminants only minimum amounts of particles and gases. Besides inert gases such as nitrogen and argon, many gases called speciality gases are also used as gases for manufacturing semiconductors. Examples of the speciality gases include corrosive gases such as chlorine, hydrogen chloride and hydrogen bromide, and chemically-unstable gases such as silane. For the former gases is required corrosion resistance, and for the latter gases is required non-catalytic property (the property of preventing the decomposition of silane gas or the like to produce particles, which is caused due to the catalytic property of the inner surface of a pipe).

Heretofore, in order to reduce the deposition or adsorption of dust or water, the inner surface of the pipe or the member for gases used for manufacturing semiconductors has been smoothed until the roughness thereof in $R_{max}$ becomes 1 micron or less. Cold drawing, mechanical polishing, chemical polishing, electropolishing, or the combination thereof can be mentioned as the method for smoothing the inner surface of the pipe or the member. However, a highly-smoothed material having an $R_{max}$ of 1 micron or less is chiefly obtained by means of electropolishing. The pipe or the like whose inner surface is smoothed is then washed with high-purity water, and dried by a high-purity gas to obtain a final product.

Welding is generally adopted when a pipe line is laid. This is because welding can ensure high strength and good airtightness to the pipe line. In the laying of a pipe line by welding, usually a high-purity inert gas, typically argon gas is allowed to run as a shielding gas through a pipe whose inner surface will come into contact with a high-purity gas, in order to avoid, as much as possible, contamination and oxidation of a part which is heated to high temperatures. Further, after the pipe line is laid, the pipes are purged with high-purity argon or nitrogen gas to remove those particles which are still remaining in the pipes. It takes several days to several weeks for this purging operation when the pipe line is long and complicated, such as a plant pipe line. Recently, decrease in the cost of the construction of a semiconductor-manufacturing plant and the early operation of the plant have been strongly demanded. To meet these demands, it is now required to shorten the purging time.

Besides the aforementioned properties, the pipe and the member for high purity gases are required to have weldability; the joint area thereof to which mechanical sealing is applied is required to have abrasion resistance; and when parts such as joints are produced by machining, machinability is required.

On the other hand, it has been known that corrosion resistance to and non-catalytic property against speciality gases, which are required for the pipe or the like for gases used for manufacturing semiconductors, can be improved by forming a Cr oxide layer on the surface of stainless steel by heating the steel under such an atmosphere in that the partial pressure of oxygen is controlled (see "Special Technique for Non-Corrosive, Non-Catalytic $Cr_2O_3$ Stainless Steel Pipes", The 24th VLSI Ultra-Clean Technology Workshop held by Ultra Clean Society, pp. 55–67, Jun. 5, 1993). It is noted that the objective material for the pipes reported in this literature is assumed to be SUS 316L stainless steel.

The above demand of corrosion resistance and non-catalytic property is made not only for a pipe line for gases. The same demand is also made for stainless steels which are used for various types of apparatus for manufacturing semiconductors, in which a wafer is finely processed. Austenitic stainless steels, in particular, type SUS 316L is mainly used as a material for the pipes and the members of such apparatus.

Japanese Laid-Open Patent Publication No. 161145/1988 discloses non-standard high-cleanness austenitic stainless steels which are used for steel pipes arranged in a clean room. Non-metallic inclusions are reduced by limiting Mn, Si, Al and O (oxygen) contents so as to decrease the production of the previously-mentioned particles from the inner surface of the pipes.

Further, Japanese Laid-Open Patent Publication No. 198463/1989 discloses stainless steel members for an apparatus used for manufacturing semiconductors. These members are produced in such a manner in that stainless steel after subjected to electropolishing is heated in an oxidizing gas which is under the specific conditions to form thereon an oxide layer having a thickness of 100 to 500 angstrom, in which the proportion of the number of Ni atoms in the outer part of the layer and that of the numbers of Cr atoms in the inner part of the layer are in respective predetermined ranges.

Furthermore, Japanese Laid-Open Patent Publication No. 59524/1993 discloses stainless steel members for an ultra-high vacuum apparatus, which are obtained by forming a $Cr_2O_3$ layer having a thickness of 20 to 150 angstrom on the surface layer of stainless steel in which Cr and Mo contents are in a specific relation. It is described that this layer can be obtained, for example, by heating the stainless steel at 250° to 550° C. under such an atmosphere in that the partial pressure of oxygen is 5 Pa (50 ppm) or less.

It can be expected that non-dusting characteristics under steady state conditions, which are indispensable for a stainless steel pipe for high-purity gases, are obtained by smoothing the inner surface of the pipe, and by reducing non-metallic inclusions as described in Japanese Laid-Open Patent Publication No. 161145/1988. However, when pipes or members are laid by welding, the welds thereof produce a large amount of dust. This is an essential problem for a pipe line for high-purity gases, for which the characteristics of producing no dust or only a few dust particles are important.

Regarding the dust which is produced when the pipes or members are welded, the particles remaining therein are removed by means of purging after they are laid as described previously. However, to purge a complicated pipe line in a whole plant creates two problems from the viewpoints of decreasing the cost of plant construction and of the necessitating the early operation of the plant. These problems cannot be successfully solved by the conventionally adopted methods, such as the smoothing of the surface of stainless steel, and the simple reduction of non-metallic inclusions contained in steel.

Further, the previously-described corrosion resistance and non-catalytic property against speciality gases can be improved by forming a Cr oxide layer on the surface of stainless steel. When the method for producing a pipe or a member for gases used for manufacturing semiconductors is taken into consideration, the treatment for forming a Cr oxide layer should be carried out after the surface of the stainless steel which will come into contact with a gas is smoothed by means of electropolishing. However, since the diffusion of Cr is slow in conventional austenitic stainless steel, it is not easy to form on the steel a Cr oxide layer which can sufficiently show the above properties even when the steel is subjected to the oxidation treatment after it is smoothed by electropolishing. This problem cannot be solved even by reducing the amount of non-metallic inclusions.

DISCLOSURE OF THE INVENTION

An object of the present invention is to provide austenitic stainless steels used for a pipe line for high-purity gases, which meet the non-dusting characteristics required when a pipe line is laid by welding, as well as corrosion resistance, abrasion resistance, machinability and weldability. Another object of the invention is to provide high Cr stainless steels (ferritic stainless steels and duplex stainless steels) used for a pipe line for high-purity gases, which can readily form thereon a Cr oxide layer having excellent corrosion resistance and non-catalytic property after they are smoothed by means of electropolishing.

The above objects can be attained by the following stainless steels (1) to (3) for high-purity gases.

Amend pages 5 and 6

(1) Austenitic stainless steel for high-purity gases, characterized by comprising 10 to 40% by weight of Ni, 15 to 30% by weight of Cr, 0 to 7% by weight of Mo, 0 to 3% by weight of Cu, 0 to 3% by weight of W, 0.005 to 0.30% by weight of N, 0 to 0.02% by weight of B, 0 to 0.01% by weight of Se, and Fe and unavoidable impurities as the remaining part, provided that the impurities contain 0.03% by weight or less of C, 0.50% by weight or less of Si, 0.20% by weight or less of Mn, 0.01% by weight or less of Al, 0.02% by weight or less of P, 0.003% by weight or less of S and 0.01% by weight or less of 0, and that the Ni-bal. value obtained from the following equation <1> is 0 or more and less than 2:

$$\text{Ni-bal.}=\text{Ni eq.}-1.1\times\text{Cr eq.}+8.2 \quad \langle 1\rangle$$

where

Ni eq.(%)=%Ni+%Cu+0.5%Mn+30 (%C+%N)

Cr eq.(%)=%Cr+1.5%Si+%Mo+%W

It is desirable that the B and Se contents of this stainless steel be in the following respective ranges:

B: 0.001 to 0.02%; and

Se: 0.0005 to 0.01%.

(2) Ferritic stainless steel for high-purity gases, characterized by comprising 20 to 30% by weight of Cr, 0.1 to 5% by weight of Mo, 0 to 3% by weight of Ni, 0 to 1% by weight of Ti, 0 to 1% by weight of Nb, 0.03% by weight or less of N, 0 to 0.5% by weight of Cu, 0.1 to 0.5% by weight of W, and Fe and unavoidable impurities as the remaining part, provided that the impurities contain 0.03% by weight or less of C, 0.5% by weight or less of Si, 0.2% by weight or less of Mn, 0.05% by weight or less of Al, 0.02% by weight or less of P, 0.003% by weight or less of S and 0.01% by weight or less of 0.

It is desirable that the Ti, Nb and Cu contents of this stainless steel be in the following respective ranges:

Ti:0.1 to 1%;

Nb:0.1 to 1%; and

Cu:0.1 to 0.5%

(3) Duplex stainless steel for high-purity gases, characterized by comprising 4 to 8% by weight of Ni, 20 to 30% by weight of Cr, 0.1 to 5% by weight of Mo, 0.1 to 0.3% by weight of N, 0 to 0.5% by weight of Cu, 0 to 0.5% by weight of W, and Fe and unavoidable impurities as the remaining part, provided that the impurities contain 0.03% by weight or less of C, 0.5% by weight or less of Si, 0.2% by weight or less of Mn, 0.05% by weight or less of Al, 0.02% by weight or less of P, 0.003% by weight or less of S and 0.01% by weight or less of 0.

It is desirable that the Cu and W contents of this stainless steel be in the following respective ranges:

Cu, W: both are 0.1 to 0.5%

BRIEF DESCRIPTION OF THE DRAWINGS

FIG. 2 is a table showing the chemical compositions of the seamless steel pipes used in Test 1;

FIG. 3 shows the welding conditions in Test 1; and

FIG. 4 shows the numbers of particles produced during the welding, the results of the composition analysis of the particles, and the hardnesses of the steels of the present invention.

FIG. 5 shows the chemical compositions of the steels of the present invention used in Test 2;

FIG. 6 shows the chemical compositions of the comparative steels used in Test 2; and FIG. 7 shows the conditions of drill-boring conducted to examine the machinability of the steels. Further, FIG. 8 shows the results of Test 2 obtained in terms of the steels of the present invention; and FIG. 9 shows the results of Test 2 obtained in terms of the comparative steels.

FIG. 10 is a table showing the chemical compositions of the seamless steel pipes used in Test 3; and FIG. 11 is a table showing the results of Test 3.

BEST MODE FOR CARRYING OUT THE INVENTION

Figure 1:
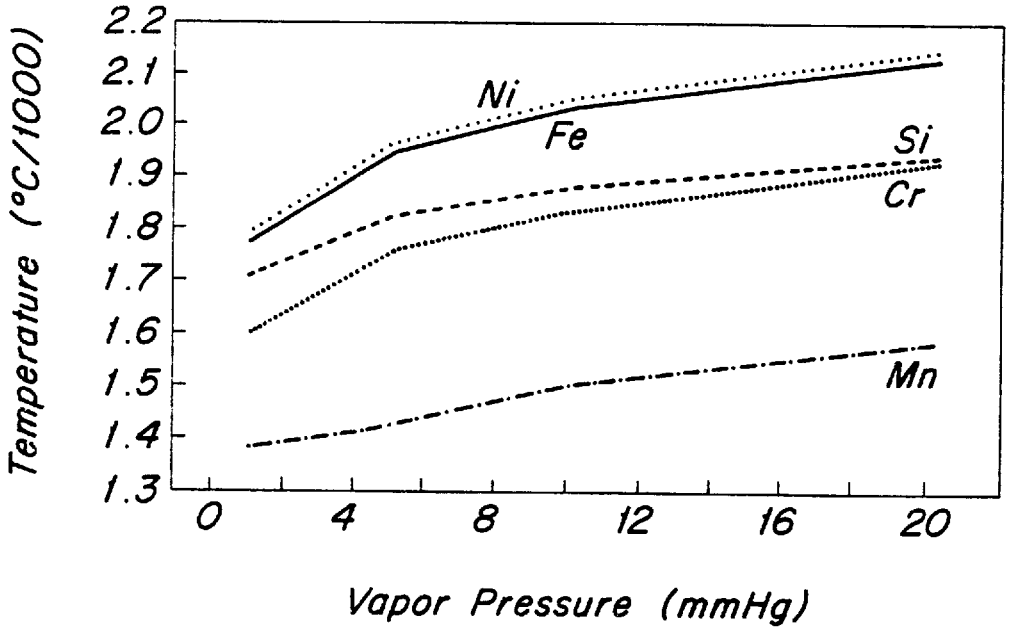
FIG. 1 is a graph showing the relationship between vapor pressure and temperature in terms of the main alloying elements of stainless steel.

In order to develop pipes for high-purity gases having superior non-dusting characteristics by clarifying dusting behavior at the time of welding, the inventors of the present invention welded SUS 316L stainless steel pipes whose inner surface had been smoothed by means of electropolishing, counted the number of particles produced during the welding, and analyzed the particles to determine the chemical composition thereof. As a result, it became clear that the main component of the particles produced was Mn, which is an alloying element of the stainless steel. The reason of this fact will be explained by referring to FIG. 1.

FIG. 1 is a graph showing the relationship between vapor pressure and temperature in terms of the main alloying elements of stainless steel (see "Handbook of Chemistry", pp. 702–705, Maruzen Co., Ltd., 1975). As shown in the graph, the vapor pressure of Mn is remarkably higher than those of the other elements in the range of 1400° to 1600° C. in which the melting point of SUS stainless steel falls. This graph shows the above relationship in terms of the metals which are pure. However, it is understood that this tendency can be applied as it is to stainless steel when the vapor pressure of the gas phase at the upper part of molten stainless steel at the time of welding is considered. It is therefore considered that Mn is preferentially evaporated from the molten steel when welding is conducted, and cooled and solidified in a shielding gas to become a particle.

Further, the effect of the chemical composition of stainless steel, and particularly that of the content of Mn, by which almost all of the particles are made, on the amount of dust produced; that is, the number of the particles produced were examined. As a result, it was found that when Mn content is 0.20% by weight or less, the amount of dust which by welding is drastically reduced. In addition, the relationship between weldability or machinability and chemical composition was examined. As a result, it was found that Se content has an influence on weldability and that N and B contents have an influence on machinability.

Furthermore, in order to develop stainless steels which can readily form thereon a Cr oxide layer having high corrosion resistance and excellent non-catalytic property, the inventors of the present invention smoothed, by means of electropolishing, the inner surface of pipes made of stainless steels having various chemical compositions, and subjected the pipes to oxidation treatment. The properties, corrosion resistance and non-catalytic property of the oxide layers thus obtained were then examined.

As a result, it was found that stainless steels in which Cr level is higher and Ni level is lower than those in SUS 316L stainless steel; that is. ferritic stainless steel and duplex stainless steel, readily form thereon a Cr oxide layer when they are subjected to oxidization treatment after smoothed by means of electropolishing, and that the Cr oxide layer offers high superiority in both corrosion resistance and non-catalytic property.

The present invention has been accomplished on the basis of the above findings. The reasons why the chemical compositions of the stainless steels defined in the present invention, and the Ni-bal. value of the austenitic stainless steels of the invention are restricted to the previously-mentioned ranges will now be explained. Hereinafter, "%" means "% by weight".

Ni:

10 to 40% in the austenitic stainless steels;

0 to 3% in the ferritic stainless steels; and 4 to 8% in the two-phase stainless steels.

Ni is an important element for the corrosion resistance and structure control of the austenitic stainless steels. In order to maintain and stabilize the structure of austenite, and to keep the corrosion resistance of the steels, the range of Ni content was restricted to 10 to 40%. When Ni content is less than 10%, the structure of austenite cannot be stabilized. On the other hand, when Ni content is in excess of 40%, the effects of Ni are saturated, and the production cost is also increased; such a high Ni content is uneconomical.

An addition of a small amount of Ni to the ferritic stainless steels is effective for improving toughness, so that it is desirable to incorporate Ni into the steels, when necessary. In the case where Ni is intentionally added to the ferritic stainless steels to obtain this effect, it is desirable to make the lowest limit of the amount of Ni added to 0.1%. The more preferable amount of Ni is 0.2% or more. On the other hand, when more than 3% of Ni is added to the ferritic stainless steels, an extremely small amount of austenite is produced therein, and toughness and corrosion resistance are thus impaired.

In order to maintain the corrosion resistance and toughness of the duplex stainless steels, it is necessary to control the proportion of austenite contained in the whole structure to 40 to 60%. When Ni content is less than 4%, the proportion of austenite is insufficient. On the contrary, the proportion of austenite becomes excessively high when Ni content exceeds 8%. Thus,corrosion resistance and toughness are impaired in either cases. The preferable range of Ni content is from 5 to 7%.

Cr: 15 to 30% in the austenitic stainless steels; and 20 to 30% in the ferritic stainless steels and in the duplex stainless steels.

Cr is also, like Ni, an important element for the corrosion resistance and structure control of the austenitic stainless steels. The range of the Cr content of the austenitic stainless steels was restricted to 15 to 30%. When Cr content is less than 15%, even minimum corrosion resistance required for stainless steels cannot be obtained. On the other hand, when Cr content is in excess of 30%, intermetallic compounds tend to separate out, so that hot-workability and mechanical properties are impaired.

Cr is an important element in high Cr stainless steels. This is because Cr improves the corrosion resistance of the steels themselves, and, at the same time, makes the steels easily form thereon a Cr oxide layer. For this reason, with respect to the ferritic stainless steels and the duplex stainless steels, the range of Cr content was fixed to 20 to 30%. When Cr content is less than 20%, a Cr oxide layer cannot be satisfactorily formed. On the other hand, when Cr content is more than 30%, intermetallic compounds tend to separate out, and toughness is thus impaired. The preferable range of Cr content is from 24 to 30%.

Mo: 0 to 7% in the austenitic stainless steels; and 0.1 to 5% in the ferritic stainless steels and in the duplex stainless steels.

Reduction of the amount of dust which is produced when welding is conducted is the main purpose of the austenitic stainless steels of the present invention. However, corrosion resistance is also one of the important properties for the austenitic stainless steels as mentioned previously. Therefore, Mo, which has the effect of improving corrosion resistance, may be added to the steels within such a range that the other properties such as hot-workability and weldability are not marred. In the case where Mo is intentionally added to the steels, one or more elements selected from Mo, and Cu and W, which will be described later, are added. In order to obtain the above effect, it is desirable to make the lowest limit of Mo content to 0.1%. When Mo content is in excess of 7%, the effect of improving corrosion resistance is saturated.

Amend page 10

In the case of the high Cr stainless steels of the present invention, Mo is added in order to improve corrosion resistance to corrosive gases. When Mo content is less than 0.1%, this effect cannot be obtained. On the other hand, when Mo content is in excess of 5%, intermetallic compounds separate out, and toughness is impaired. The preferable range of Mo content is from 1 to 4%.

Cu, W: both Cu and W are 0 to 3% in the austenitic stainless steel; Cu is 0 to 0.5% and W is 0.1 to 0.5% in the ferritic stainless steels and both of them are 0 to 0.5% in the duplex stainless steels.

As mentioned above, corrosion resistance is also one of the important properties for the austenitic stainless steels which require non-dusting characteristics. Cu and W are elements which have, like Mo, the effect of improving corrosion resistance. Therefore, they may be added to the austenitic stainless steels within such a range that the other properties such as hot-workability and weldability are not marred. In the case where Cu or W is intentionally added, one or more elements selected from Mo, Cu and W are incorporated into the steels. In this case, it is desirable to make both the lowest limit of Cu content and that of W content to 0.1% in order to obtain the above effect. When both Cu and W contents are in excess of 3%, the effect of improving corrosion resistance is saturated.

In the ferritic stainless steel according to the present invention, it is preferred to use W as the essential ingredient for ensuring corrosion resistance and use Cu as necessary. When the W content is less than 0.1%, the effect of improving corrosion resistance can not be obtained and the effect is saturated when it exceeds 0.5%, so that the content is defined as 0. 1 to 0.5%. If Cu is added intentionally, the content is preferably from 0.1 to 0.5%.

In the duplex stainless steel, since Cu and W improve corrosion resistance, one or both of them may be used preferably as necessary. In a case of intentional addition for obtaining the effect, the lower limit for the content is preferably 0.1% for each of them. On the other hand, if each of them exceeds 0.5%, the effect described above is saturated.

C: 0.03% or less.

C makes Cr carbide separate out at a weld to impair corrosion resistance, so that it is necessary to reduce C content. C content was therefore restricted to 0.03% or less in consideration of the use of the steels of the present invention for strongly-corrosive gases. The preferable range of C content is 0.02% or less.

Si: 0.50% or less.

Although Si has the action of deoxidizing steels to purify the steels, it also produces, at the same time, oxide inclusions. When Si content is in excess of 0.50%, the inclusions become large, and non-dusting characteristics under steady state conditions are particularly impaired. It is therefore necessary to reduce Si content. For this reason, Si content was restricted to 0.50% or less. The desirable range of Si content is 0.1% or less in the case of the austenitic stainless steels which are required to have non-dusting characteristics, and 0.2% or less in the case of the high Cr stainless steels.

Mn: 0.20% or less.

Mn has, like Si, the action of deoxidizing steels to purify the steels. However, it is the most harmful element for non-dusting characteristics required when welding is conducted. When Mn content is in excess of 0.2%, the amount of dust which is produced by welding is drastically increased. For this reason, Mn content was restricted to 0.2% or less. The desirable range of Mn content is 0.1% or less.

Al: 0.01% or less in the austenitic stainless steels; and 0.05% or less in the ferritic stainless steels and in the duplex stainless steels.

Al also has, like Si, the action of deoxidizing steels to purify the steels. However, Al produces oxide inclusions, and cause these oxide inclusions to become enlarged. Further, Al is oxidized much more easily than the other alloying elements, so that Al on the molten metal surface of pipes is reacted, when the pipes are welded, with an extremely small amount of oxygen present in the atmosphere in the pipes, whereby Al oxide is produced. Dust is produced due to either of these reasons. It is therefore necessary to reduce Al content in the case of the austenitic stainless steels. For this reason, the Al content of the austenitic stainless steels was restricted to 0.01% or less, and that of the high Cr stainless steels was restricted to 0.05% or less. The preferable range of Al content is 0.01% or less.

P: 0.02% or less.

P is harmful for hot-workability, so that it is necessary to reduce P content. However, it is difficult to reduce P content to extremely low level from the viewpoint of steel making. Further, a material in which P level is low and which is needed to produce stainless steel whose P content is extremely low is expensive. Therefore, it is not economical to reduce P content to excessively low level. For this reason, it is desirable to make P content to such a level that does not adversely affect the properties of the steels. The range of P content was thus restricted to 0.02% or less.

S: 0.003% or less.

S produces sulfide inclusions even when the amount thereof is extremely small, and therefore impairing corrosion resistance. It is necessary to reduce S content. The range of S content was restricted to 0.003% or less so as not to impair corrosion resistance and economical efficiency. The desirable range of S content is 0.002% or less.

O (oxygen): 0.01% or less.

O is an element which produces oxide inclusions in steels, so that it is necessary to reduce O as much as possible. The oxide inclusions are agglomerated and become large at a weld when welding is conducted. In order to reduce the amount of dust particles during the weld, the range of O content in the steel was restricted to 0.01% or less so as not to adversely affect non-dusting characteristics. The preferable range of O content is 0.005% or less.

N alone or N and B in combination is incorporated into the austenitic stainless steels of the present invention. Further, N content is suppressed as much as possible in the ferritic stainless steels, whereas N is incorporated into the duplex stainless steels.

N: 0.005 to 0.30% in the austenitic stainless steel, 0.03% or less in the ferritic stainless steel and 0.1 to 0.3% the duplex stainless steel.

In the austenitic stainless steels, N is an element contained inevitably in the steel. However, N acts as an alloying element having an effect of enhancing strength, hardness and corrosion resistance. In the austenitic stainless steel according to the present invention, since C, Si, Mn, P, S and O are elements having the dust enhancing effect are reduced as described above, hardness is lowered as compared with general stainless steels. Decrease in hardness is not a great problem for stainless steel pipes for high-purity gases. However, in the case of the pipeline parts having a slidable portion on a gas sealing surface such as various types of valves, it is necessary to increase hardness in order to improve the abrasion resistance of the slidable portion. For such a purpose, it is effective to increase hardness by addition of N.

When the N content of the austenitic stainless steels is less than 0.005%, the above-described effect of increasing hardness can not be obtained. On the other hand, when it is more than 0.30%, it separates out as nitride and corrosion resistance is impaired. Therefore, the range of N content is 0.005 to 0.30%. The desirable range is 0.1 to 0.25%.

In the case of ferritic stainless steels, even if an extremely small amount of N is added to the steels, Cr nitride is produced, and toughness is impaired. In order to prevent the decrease in toughness, it is necessary to control N content to 0.03% or less. The preferable range of N content is 0.01% or less.

In the case of the duplex stainless steels, N and the austenite phase form a solid solution to improve corrosion resistance. When N content is less than 0.1%, this effect cannot be obtained. On the other hand, when N content is in excess of 0.3%, Cr nitride is produced, and toughness is thus impaired. The preferable range of N content is from 0.15 to 0.3%.

B: 0 to 0.02% in the austenitic stainless steels.

B is an element which produces nitride. When B (in addition to the above-described N) is added to the austenitic stainless steels, not only hardness but also machinability is improved. This is because extremely fine nitride, BN, separates out to improve the crushability of shavings. In order to obtain this effect, it is necessary that N content be in the range of 0.01 to 0.30% and that B content be 0.001% or more. On the other hand, when B content is in excess of 0.02%, nitride separates out excessively so that corrosion resistance is impaired. For this reason, the range of B content was restricted to 0.001 to 0.02%. The desirable range of B content is from 0.005 to 0.01%.

It is possible to further incorporate Se into the austenitic stainless steels of the present invention.

Se: 0 to 0.01% in the austenitic stainless steels.

Since Se has the effect of improving arc stability required in arc welding which is ordinarily conducted, and the effect of suppressing the change in shape of molten metals, Se is added to the austenitic stainless steels, when necessary. In the case where Se is intentionally added to the steels, the above effects cannot be obtained when Se content is less than 0.0005%. On the other hand, when Se content is in excess of 0.01%, non-metallic inclusions are formed, and corrosion resistance is thus impaired. For this reason, the range of Se content was restricted to 0.0005 to 0.01%. The desirable range of Se content is from 0.001 to 0.005%.

One or both of Ti and Nb can be further incorporated into the ferritic stainless steels of the present invention, when necessary.

Ti, Nb: both are 0 to 1% in the ferritic stainless steels.

In order to stabilize C and N which produce Cr precipitates, it is effective to add Ti and/or Nb, which produces stable carbon nitride, to the ferritic stainless steels. It is therefore desirable to add Ti and/or Nb, when necessary. When they are intentionally added to the steels to obtain the above effect, it is desirable to make both the lowest limit of Ti content and that of Nb content to 0.1%. On the other hand, when both Ti and Nb contents are in excess of 1%, the above effect is saturated. The more preferable range of Ti content and that of Nb content are from 0.2 to 0.5%.

The austenitic stainless steels of the present invention is further defined by the Ni-bal. value which is obtained from the previously-given equation <1>.

Ni-bal. value: 0 or more and less than 2.

When the Ni-bal. value is less than 0, the structure of austenite cannot be stably obtained, and only such a structure that contains a ferrite phase is obtained. Mechanical properties and corrosion resistance are thus impaired. On the other hand, when this value is 2 or more, hot-workability is impaired. When steel ingots are produced on a small laboratory scale, trouble will not occur even if hot-workability is poor. However, when the steel ingots are mass-produced on a commercial scale, these ingots tend to crack during forging and rolling processes. For this reason, the Ni-bal. value which is calculated from the contents of the alloying elements of the steels of the present invention was restricted to 0 or more and less than 2.

The effects of the stainless steels for high-purity gases of the present invention will now be explained by referring to the following examples, that is, Test 1 to Test 3.

Test 1

The inner surface of seamless pipes having an outer diameter of 6.4 mm, a thickness of 1 mm and a length of 4 m, made of SUS 316L stainless steels having a chemical composition shown in FIG. 2 was smoothed by means of electropolishing until the $R_{max}$ of the surface became 0.7 micron or less. Thereafter, the inner surface of the pipes was washed with high-purity water, and dried by allowing 99.999% Ar gas to run through the pipes at 120° C. The pipes made of a steel of the same type were welded by an automatic welder without conducting edge preparation under the conditions shown in FIG. 3 so that the weld, that is, the weld bead would come on the inner surface of the pipe. Ar shielding gas which was allowed to run through the pipe during this welding was introduced to a particle counter at the downstream side of the weld to count the number of particles produced. The amount of dust produced was evaluated in such a manner.

Further, the above Ar shielding gas was directly blown into 1 mol/l hydrochloric acid. The concentrations of the metals in the hydrochloric acid were then measured, thereby determining the composition of the particles.

The number of particles produced, the results of the composition analysis, and the hardnesses of the pipes made of the steels of the present invention at the central part thereof (the part not affected by the welding) are shown in FIG. 4.

The results shown in FIG. 4 demonstrate that the austenitic stainless steels having a chemical composition defined in the present invention produce a minute amount of dust when the steels are welded. This effect is obtained due to the reduced Mn and Al contents of the steels. Further, those steels of the present invention which contain N have hardness 17–56% higher than those of the other steels.

Test 2

Stainless steels having a chemical composition shown in FIGS. 5 and 6 were produced in a vacuum induction heating furnace, and processed into pipes and plates by means of hot processing and cold processing. Thereafter, the pipes and the plates were treated at 1000° C. under $H_2$ gas atmosphere so as to form solid solutions.

The steel pipes obtained were subjected to electropolishing, and then tests for evaluating the corrosion resistance and abrasion resistance thereof were carried out. Further, after the polished pipes were welded, the number of particles produced from the inner surface of the pipes were counted; the particles were subjected to composition analysis; a weldability test was carried out; and machinability was tested by using the plates obtained.

The conditions of the electropolishing and those of the welding, the method for counting the number of the particles produced and that of the composition analysis of the particles, and the conditions such as the dimension of the steel pipes used are the same as those in Test 1.

A corrosion resistance test was carried out as follows: The pipe after being subjected to electropolishing was cut lengthwise in half, and a filter paper impregnated with an aqueous ferric chloride solution was stuck to the inner surface of the pipe. This was preserved at 25° C. for 6 hours, and the inner surface of the pipe was then observed as to whether corrosion occurred or not. The test was carried out by changing the concentration of the aqueous ferric chloride solution, and corrosion resistance was evaluated by the critical concentration of the solution for pitting. Abrasion resistance was evaluated by the Vickers hardness of the cross-section of the pipe which had been subjected to electropolishing.

Weldability was evaluated in the following manner: The pipes after being subjected to electropolishing were welded at the circumference thereof under the same conditions as in Test 1. The weld was cut lengthwise in half, and the width of the bead on the inner surface of the pipe was measured. Weldability was evaluated by the variation of the width in the circumferential direction.

Machinability was evaluated as follows: The plate material having a thickness of 9 mm was bored by using a drill under the conditions shown in FIG. 7. Machinability was evaluated by the number of bores which were obtainable by using one drill. The results of the above tests are shown in FIGS. 8 and 9.

The results shown in FIGS. 8 and 9 clearly demonstrate that the austenitic stainless steels having a chemical composition defined in the present invention produce only a minute amount of dust when they are welded. This effect is obtained due to the reduced Mn, Al, Si and O contents of the steels. It is clear that the austenitic stainless steels of the present invention are also superior in corrosion resistance, abrasion resistance and machinability.

Test 3

Stainless steels having a chemical composition shown in Table 10 were produced. They were subjected to hot extrusion, and then processed into seamless steel pipes having an outer diameter of 6.4 mm, a thickness of 1 mm, and a length of 1 m by cold rolling and cold drawing.

The inner surface of the pipes obtained was smoothed by means of electropolishing to make the $R_{max}$ of the surface to 0.7 micron or less, washed with high-purity water, and then dried by allowing 99.999% Ar gas to run through the pipe at 120° C. The steel pipes finally obtained were subjected to oxidation treatment under the following conditions to form an oxide layer thereon.

Conditions of oxidation treatment: Preserved at 550° C. for 3 hours in the stream of Ar gas containing 10% of hydrogen and 100 ppm of water vapor.

After the oxidation treatment was carried out, the thickness of the oxide layer and the Cr concentration in the oxide layer were measured, and the water-discharging property, corrosion resistance and catalytic property of the inner surface of the pipes were examined to totally evaluate the pipes.

The Cr oxide layer was evaluated in the following manner: The pipe was cut lengthwise in half, and the distribution of elements in the direction of the depth of the inner surface of the pipe was determined by a secondary ion mass spectrometer. The maximum Cr concentration in all metal elements contained in the oxide layer, and the thickness of a Cr rich portion of the oxide layer were obtained.

Water-discharging property was evaluated in the following manner: The pipe after being subjected to the oxidation treatment was allowed to stand for 24 hours in a laboratory where the humidity was 50%. While high-purity Ar gas containing less than 1 ppb of water was being allowed to run through the pipe at a rate of 1 liter/min, the concentration of vapor in the gas was measured at the output end of the pipe by an atmospheric pressure ionization mass spectrometer. Water-discharging property was evaluated by the time required for the vapor concentration to become 1 ppb from the beginning of the measurement.

Corrosion resistance was evaluated in the following manner: 5 atoms of hydrogen bromide gas was charged in the pipe which had been subjected to the oxidation treatment, and the pipe was sealed. This pipe was preserved at 80° C. for 100 hours. Thereafter, the inner surface of the pipe was observed by a scanning electron microscope as to whether the surface underwent any change.

Catalytic property was evaluated as follows: Ar gas containing 100 ppm of monosilane ($SiH_4$) was allowed to run through the pipe which had been subjected to the oxidation treatment, by changing the temperature of the pipe. The concentration of $H_2$ generated by the decomposition of the monosilane was measured at the output end of the pipe by gas chromatography. Catalytic property was evaluated by the minimum decomposition temperature of the monosilane. The results of the above tests are shown in FIG. 11.

The results shown in FIG. 11 clearly demonstrate that the oxide layers formed by subjecting the ferritic or duplex stainless steels of the present invention to oxidation treatment have a high Cr concentration and are thick and that such oxide layers are useful for improving the water-discharging property and the non-catalytic property, as well as the corrosion resistance.

Industrial Applicability

The austenitic stainless steels of the present invention are steels which have decreased Mn, Al, Si and O contents and which meet the non-dusting characteristics required at the time of welding. In addition, corrosion resistance, abrasion resistance and machinability are more improved. The ferritic and duplex stainless steels of the present invention are steels which can readily form thereon a Cr oxide layer having superior corrosion resistance and non-catalytic property when they are subjected to oxidation treatment. Therefore, all of the steels of the present invention are suitable as stainless steels for high-purity gases used for apparatus for manufacturing semiconductors or liquid crystals, and can thus be utilized in the field of the manufacturing of semiconductors or liquid crystals.

What is claimed is:

1. Austenitic stainless steel for high-purity gases, characterized by comprising 10 to 40% by weight of Ni, 15 to 30% by weight of Cr, 0 to 7% by weight of Mo, 0 to 3% by weight of Cu, 0 to 3% by weight of W, 0.005 to 0.30% by weight of N, 0 to 0.02% by weight of B, 0 to 0.01% by weight of Se, and Fe and unavoidable impurities as the remaining part, provided that the impurities contain 0.03% by weight or less of C, 0.50% by weight or less of Si, 0.20% by weight or less of Mn, 0.01% by weight or less of Al, 0.02% by weight or less of P, 0.003% by weight or less of S and 0.01% by weight or less of O, and that the Ni-bal. value obtained from the following equation <1> is 0 or more and less than 2:

$$\text{Ni-bal.}=\text{Ni eq.}-1.1\times\text{Cr eq.}+8.2 \quad \langle 1\rangle$$

where

Ni eq.(%)=%Ni+%Cu+0.5%Mn+30 (%C+%N)

Cr eq. (%)=%Cr+1.5%Si+%Mo+%W.

2. The austenitic stainless steel for high-purity gases according to claim 1, comprising 0.001 to 0.02% by weight of B.

3. The austenitic stainless steel for high-purity gases according to claim 1, comprising 0.0005 to 0.01% by weight of Se.

4. The austenitic stainless steel for high-purity gases according to claim 1, wherein Mn is less than 0.10% by weight.

5. The austenitic stainless steel for high-purity gases according to claim 1, wherein Mo is present in an amount of 1 to 4% by weight.

6. The austenitic stainless steel for high-purity gases according to claim 1, wherein Cu is present in an amount of at least 0.1% by weight.

7. The austenitic stainless steel for high-purity gases according to claim 1, wherein W is present in an amount of at least 0.1% by weight.

8. The austenitic stainless steel for high-purity gases according to claim 1, wherein C is present in an amount of 0.02% by weight or less.

9. The austenitic stainless steel for high-purity gases according to claim 1, wherein Si is present in an amount of 0.1% by weight or less.

10. The austenitic stainless steel for high-purity gases according to claim 1, wherein S is present in an amount of 0.002% by weight or less.

11. The austenitic stainless steel for high-purity gases according to claim 1, wherein oxygen is present in an amount of 0.005% by weight or less.

12. The austenitic stainless steel for high-purity gases according to claim 1, wherein N is present in an amount of 0.1 to 0.25% by weight.

13. The austenitic stainless steel for high-purity gases according to claim 1, wherein B is present in an amount of 0.001 to 0.02% by weight.

14. The austenitic stainless steel for high-purity gases according to claim 1, wherein Se is present in an amount of 0.001 to 0.005% by weight and Ti and/or Ni is present in an amount of 0.2 to 0.5% by weight.

15. The austenitic stainless steel for high-purity gases according to claim 1, wherein the steel comprises a pipeline of a high purity gas supply of a semiconductor manufacturing apparatus, the pipeline having an inner surface with a roughness $R_{max}$ of 0.7 micron or less.

* * * * *